US006360971B1

(12) United States Patent
Keller

(10) Patent No.: US 6,360,971 B1
(45) Date of Patent: Mar. 26, 2002

(54) METHOD AND APPLIANCE FOR ATOMIZING LIQUID FUEL FOR A FIRING INSTALLATION

(75) Inventor: Jakob Keller, deceased, late of Wohlen (CH), by Maria Keller, Vera Keller and George Keller, legal representatives

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/438,587

(22) Filed: Nov. 12, 1999

(30) Foreign Application Priority Data

Nov. 25, 1998 (DE) ..... 198 54 382

(51) Int. Cl.[7] ..... B05B 1/26; B05B 7/10; F23D 11/36; F23D 11/16

(52) U.S. Cl. ..... 239/543; 239/544; 239/545; 239/406; 239/420

(58) Field of Search ..... 239/5, 8, 11, 543, 239/544, 545, 521, 499, 420, 406, 434.5, 418; 251/125

(56) References Cited

U.S. PATENT DOCUMENTS

| | | | | |
|---|---|---|---|---|
| 1,129,616 A | | 2/1915 | Weyland | |
| 1,531,877 A | | 3/1925 | Reimers | |
| 3,074,231 A | * | 1/1963 | Klein | 239/543 |
| 3,641,988 A | | 2/1972 | Torazza et al. | 123/90.16 |
| 3,911,879 A | | 10/1975 | Altmann | 123/90.16 |
| 4,494,699 A | * | 1/1985 | Hengesbach | 239/499 |
| 4,588,375 A | | 5/1986 | Sandström | |
| 4,600,151 A | * | 7/1986 | Bradley | 239/406 |
| 5,003,939 A | | 4/1991 | King | 123/90.16 |
| 5,148,783 A | | 9/1992 | Shinkai et al. | 123/90.16 |
| 5,249,747 A | * | 10/1993 | Hanson et al. | 239/373 |
| 5,301,636 A | | 4/1994 | Nakamura | 123/90.16 |
| 5,365,895 A | | 11/1994 | Riley | 123/90.16 |
| 5,456,224 A | | 10/1995 | Riley | 123/90.16 |
| 5,540,200 A | * | 7/1996 | Naitoh et al. | 123/299 |
| 5,572,962 A | | 11/1996 | Riley | 123/90.16 |
| 5,685,494 A | * | 11/1997 | Kubach et al. | 239/585.5 |
| 5,845,846 A | * | 12/1998 | Watanabe et al. | 239/8 |
| 5,937,809 A | | 8/1999 | Pierik et al. | 123/90.16 |
| 6,042,025 A | * | 3/2000 | Crampton et al. | 239/337 |

FOREIGN PATENT DOCUMENTS

| | | |
|---|---|---|
| DE | 23 35 632 | 1/1975 |
| DE | 23 35 695 | 5/1975 |
| DE | 23 63 891 | 6/1975 |
| DE | 24 28 915 | 1/1976 |
| EP | 0321809 B1 | 5/1991 |
| EP | 0503319 A2 | 9/1992 |
| EP | 05141622 | 6/1993 |
| FR | 1026664 | 5/1953 |
| GB | 621785 | 4/1949 |
| GB | 1029521 | 5/1966 |

OTHER PUBLICATIONS

European Search Report, Jun. 1999.
European Search Report, Feb. 2000.

* cited by examiner

*Primary Examiner*—David A. Scherbel
*Assistant Examiner*—Davis Hwu
(74) *Attorney, Agent, or Firm*—Burns, Doane, Swecker & Mathis, L.L.P.

(57) ABSTRACT

A method and an appliance are described for atomizing liquid fuel for a firing installation, preferably for a combustion chamber of a gas turbine installation, having a nozzle arrangement through which the pressurized liquid fuel passes and is atomized to form a fuel spray. The invention is characterized by the fact that after the passage of the fuel through the nozzle arrangement (3, 4), at least two, spatially separated fuel sprays (5, 6) are formed in which the fuel is mainly present in the form of individual fuel droplets (16), and in that the fuel sprays (5, 6) each have a propagation direction relative to one another such that the fuel droplets (16) of one fuel spray (5) collide with the fuel droplets (16) of the other fuel spray (6) in such a way that, during the collision of the fuel droplets (16), a droplet cloud (9) is formed with new fuel droplets (17) whose diameter is smaller than that of the colliding fuel droplets (16).

9 Claims, 2 Drawing Sheets

METHOD AND APPLIANCE FOR ATOMIZING LIQUID FUEL FOR A FIRING INSTALLATION

FIELD OF THE INVENTION

This invention relates to method and apparatus for atomizing and burning liquid fuel, and more particularly for forming a fuel/air mixture for a combustion chamber of a gas turbine installation.

BACKGROUND OF THE INVENTION

In addition to a large number of parameters which determine the efficiency of a gas turbine and which affect both the design layout of all the individual components of a gas turbine and its mode of operation, the atomization process, by means of which the liquid fuel is to be atomized to form a fuel/air mixture which is as homogeneous as possible, plays a very decisive role in the fuel firing. In order to make it possible to carry out the combustion of the liquid fuel as completely as possible, it is the task of the fuel nozzles to atomize the liquid fuel into the finest possible fuel droplets in order to achieve, in this way, the largest possible fuel surface.

The simplest and lowest-cost fuel atomizers for liquid fuel are represented by pressurized fuel atomizers by means of which the fuel is driven through a nozzle opening at high pressure. Such, so-called SIMPLEX, atomizer nozzles are employed in combustion chamber operating concepts with burner staging and are suitable for the complete power range of a gas turbine, i.e. from the ignition process to the point where basic load operation is achieved. However, the employment of burner staging is very greatly limited because of the severe requirements with respect to the ignition process and with respect to the average temperature difference factor (OTDF) in the region of the turbine inlet. Thus the following relationship applies for the temperature difference factor OTDF:

$$OTDF\frac{T_{\mathrm{MAX}}\overline{T}_H}{\overline{T}_H - T_C}$$

with $T_{MAX}$ Maximum temperature at the turbine inlet $\overline{T}_H$ Average temperature at the turbine inlet $T_C$ Air temperature at the combustion chamber inlet (before combustion)

As a consequence of this, single-stage atomizers are exclusively employed in so-called silo combustion chambers in which one burner stage is provided, whereas multistage atomizer units, such as air-supported and compressed-air-supported atomizers are frequently employed in annular combustion chambers.

The fundamental problem in the design and layout of liquid fuel atomizer units is the quite different fuel flow rates at which the atomizer units are supplied during the operation of a gas turbine installation, starting with the ignition event and extending to the achievement of basic load operation. Thus, fuel flow rates under typical ignition conditions are less by a factor of between 10 and 20 than those under base load conditions. Also associated with this is the fact that the pressure ratios within the gas turbine installation are subjected to large changes, changing lay up to more than a factor of 100. Thus, typical pressure values for the atomization of liquid fuel under base load conditions are approximately 60 bar, whereas the atomization pressure under ignition conditions drops to between 300 and 600 m/bar. Pressure conditions are therefore reached which make it impossible to employ atomization nozzles designed for operation under base load conditions.

SUMMARY OF THE INVENTION

The invention is based on the object of providing a method and an appliance for atomizing liquid fuel for a firing installation, preferably for a combustion chamber of a gas turbine installation, having a nozzle arrangement through which the pressurized liquid fuel passes and is atomized to form a fuel/air mixture, in such a way that despite the large pressure differences described above, a single atomization unit is sufficient for undertaking the atomization necessary for optimized combustion of liquid fuel. This arrangement is to dispense with multiple staging, known per se, of the atomizing units. In particular, the atomizer appliance necessary for this purpose is to be of simple construction and be associated with only low manufacturing costs. It shall be possible to match the atomization rate and the achievable fuel droplet diameters in an optimum manner for both the ignition process and base load operation.

The invention derives from the basic concept that the minimum droplet size which can be achieved during atomization of a fluid by means of a pressurized atomizer unit is determined by the equilibrium between the surfaces tension, which holds a droplet together in its spherical shape, and the aerodynamic forces acting on the droplet from the outside, which aerodynamic forces can destroy the shape of the droplet. Thus, in the case of large droplet diameters, the aerodynamic forces are dominant so that, after the atomization process, the large droplets are really torn apart and disintegrate into smaller droplets. This process of bursting asunder into smaller droplets takes place until the surface tension becomes sufficiently large relative to the aerodynamic forces for further disintegration into even smaller fuel droplets to be prevented. This disintegration process leads to a droplet diameter which can be described by the following relationship:

$$D = C\frac{\rho_{LIQUID}\gamma}{\rho_{GAS}u_R^2} \tag{1}$$

with $\gamma$ Kinematic surface tension $P_{LIQUID}$ Density of the atomized liquid $P_{GAS}$ Density of the surrounding gas $U^2_R$ Relative velocity between droplets and surrounding gas C Constant It may be seen from the above relationship that the droplet diameter D varies as the reciprocal of the square of the relative velocity between the atomized droplets and the gas surrounding the droplets. If, on the other hand, the supply pressure necessary for the atomization process (with which, for example, the liquid fuel is supplied to the atomization nozzle) is limited, only small relative velocities u are achieved so that the reduction in droplet size is unsatisfactory in terms of the finest possible atomization. This applies particularly in gas turbines during their ignition phase, in which the supply pressure within the turbine is relatively low.

In order, nevertheless, to achieve satisfactory atomization of the liquid fuel under the pressure conditions which make the atomization process difficult, a method in accordance with the preamble to claim 1 is developed, in accordance with the invention, in such a way that—after passage of the fuel through the atomization unit configured as a nozzle arrangement—at least two, spatially separated fuel sprays are formed in which the fuel is mainly present in the form of individual fuel droplets. The fuel droplets each have a relative propagation direction such that the fuel droplets of one fuel spray collide with the fuel droplets of the other fuel spray in such a way that, during this collision of the fuel droplets, new fuel droplets are formed whose diameter is smaller than that of the colliding fuel droplets.

In contrast to the widespread concept of natural droplet disintegration due to the interaction between the surface tensions and the aerodynamic forces acting on the individual droplets, the method in accordance with the invention makes use of deliberate collision between fuel droplets after their formation as part of the atomization process.

By means of deliberate collision between fuel droplets which are formed when using a simple nozzle arrangement and an atomization pressure of approximately 500 mbar, i.e. a pressure which is usual for ignition in a gas turbine (these droplets having typical droplet diameters in the range between 2 and 5 mm), it is possible to obtain very small droplets, which emerge as "fragments" from the colliding droplets and have diameters between 10 and 100 $\mu$m. The downstream "atomization process"—based on the collision process—into still smaller droplet fragments does not correspond to the above relationship (1) because the physical mechanism which contributes to the reduction in size of the droplets is not based on the interaction between the surface tension and the aerodynamic forces acting on the individual droplets but on the collision between two droplets which consist of the same medium, of a combustible liquid in the case of the atomization of fuel. The mathematical relationship (1) simplifies, in fact, to the following relationship:

$$D \approx \frac{\gamma}{u_R^2} \tag{2}$$

Because of the disappearance of the density factors in Equation (2), a minimum droplet diameter can be obtained which is smaller by between two and three orders of magnitude as compared with classical droplet formation in accordance with Equation (1). This information on the atomization of liquid can, in accordance with the invention, be applied particularly appropriately to fuel atomization for use in gas turbines, particularly in view of the only low pressure ratios such as occur during the ignition phase in gas turbines.

A particularly advantageous possibility for producing the smallest fuel droplets by means of collision is initially based on the formation of at least two fuel sprays which can be generated within the scope of conventional atomization techniques. The fuel sprays, whose individual fuel droplets typically have droplet diameters of an order of magnitude between 1 and 5 mm, are preferably in the shape of a two-dimensional spray and their propagation directions are set relative to one another in such a way that they intersect at an acute angle. In the region of the mutually penetrating fuel sprays, collisions occur between the respective fuel droplets and these lead to extremely small fuel droplet fragments which preferentially adopt a propagation direction which is oriented along the angular bisector between the propagation directions of the two-dimensional fuel sprays which have collided with one another.

The collision geometry is typically matched to the individual combustion chamber geometry of annular combustion chambers in such a way that the extremely fine fuel droplets proceed in the direction of the combustion chamber for subsequent ignition.

A nozzle arrangement in accordance with the invention, and which operates on the atomization principle previously described, provides for at least two spatially separated nozzle outlet openings which are oriented relative to one another in such a way that the fuel sprays propagating in respectively different directions pass through a region within which the fuel droplets from the respective fuel sprays collide with one another. The nozzle outlet openings are therefore oriented relative to one another in such a way that the propagation directions of the fuel sprays emerging from the nozzle outlet openings enclose an angle a, for which $0° < \alpha < 180°$.

As an alternative to the arrangement of at least two separate nozzle outlet openings, a nozzle arrangement is provided, in accordance with the invention, having a slot nozzle which has an endless slot nozzle opening. In this arrangement, the slot nozzle opening is preferably surrounded by a deflection element which deflects the fuel emerging from the slot nozzle opening in such a way that the fuel spray forming converges within a narrowly limited volumetric region. Such a slot nozzle arrangement has, in particular, the advantage that no complicated adjustment measures have to be undertaken in order to cause the individual fuel sprays to collide within a narrowly limited region.

In addition, the slot nozzle opening can itself have a conical configuration so that the fuel spray forming converges, even without the provision of various deflection elements, in a narrowly limited volumetric region and there leads to the desired collision events.

The arrangements described above for generating extremely small fuel droplets are particularly suitable for use in double-cone burners, of which a preferred example is given in EP 0 321 809 B1.

This type of burner is considered to be a successful initial type for burners which are designed for firing using liquid fuels. In it, the liquid fuel is introduced by means of a nozzle arrangement attached centrally to the hollow conical space and is introduced to the inside of the combustion chamber in the form of a conically forming fuel spray. The conical fuel spray is surrounded by a rotating combustion air flow which enters a hollow conical space tangentially and is stabilized by this means. It is only in the region of the vortex collapse, i.e. in the region of the so-called reverse flow zone, that the optimum, homogeneous fuel concentration is achieved over the cross section, so that the ignition of the fuel spray takes place in this region.

As a supplement to the nozzle arrangement of the burner described above or, indeed, even instead of the nozzle arrangement used in the known burner, the previously described appliances in accordance with the invention can be employed for the atomization of liquid fuel, these appliances being capable of generating extremely small fuel droplets even at the time of the ignition process.

BRIEF DESCRIPTION OF THE DRAWINGS

A preferred embodiment of the invention is illustrated in the accompanying drawings in which.

DETAILED DESCRIPTION OF THE INVENTION

Figure 1A:
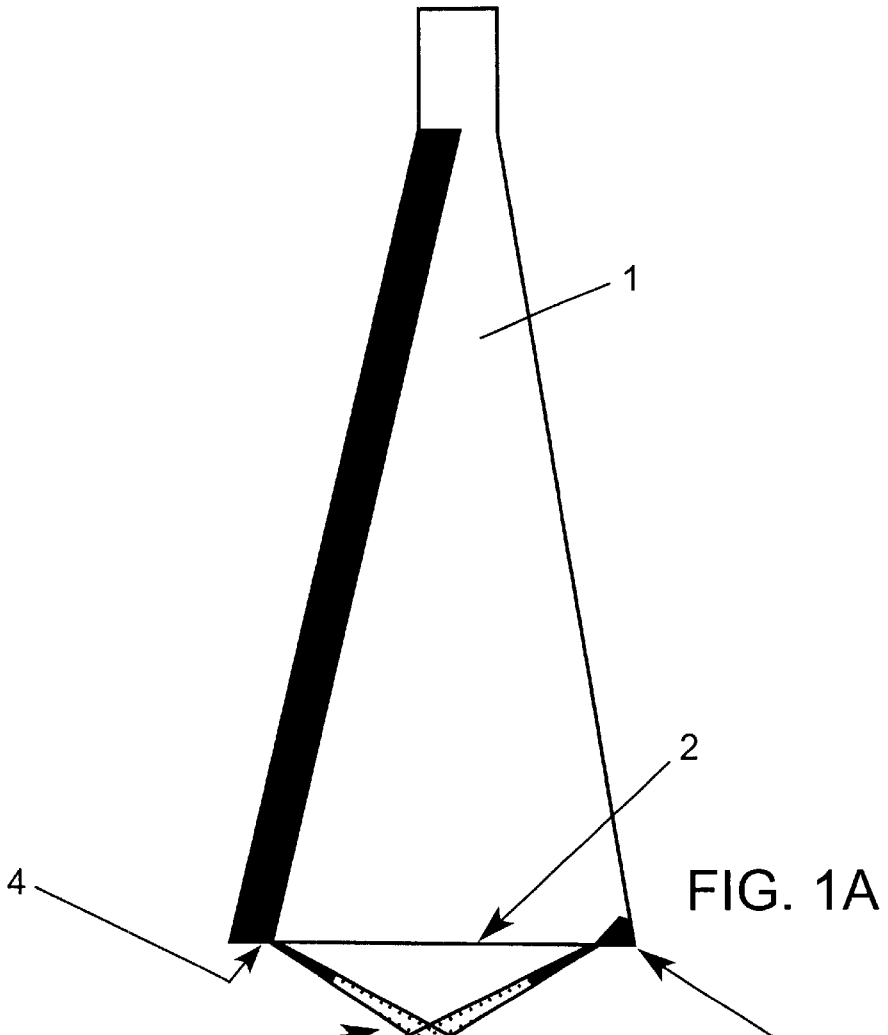
FIG. 1*a* is a longitudinal sectional representation through a prior art burner arrangement, with two nozzle outlet openings.

A conical body, consisting of two partial conical bodies 1, of a burner is shown diagrammatically in FIG. 1*a*, this burner being described, for example, in EP 0 321 809 B1. Two separate nozzle outlet openings 3 and 4 are provided at the burner outlet 2 in the embodiment example represented in FIG. 1*a*. The liquid fuel is atomized, in each of the fuel sprays 5, 6 which propagate intrinsically in fan shape, by the nozzle outlet openings 3 and 4. In this arrangement, the fuel sprays 5, 6 have macroscopic fuel droplets 16 with typical fuel droplet diameters between 1 and 5 mm. The propagation directions of the two fuel sprays 5, 6 are oriented in such a way that they pass through a narrowly limited volumetric region 7. The macroscopic fuel droplets 16 of the two fuel sprays 5, 6 collide in the volumetric region 7 and really burst into a multiplicity of smaller fuel droplets 17, which each typically have droplet diameters between 10 and 100 $\mu$m. The microscopic fuel droplets 17 forming during the collision propagate preferentially along the angular bisector 8 relative to the two main propagation directions of the fuel sprays 5, 6. A droplet cloud 9 is formed which consists of extremely small fluid droplets and has to be brought within the combustion chamber for ignition.

Figure 1B:
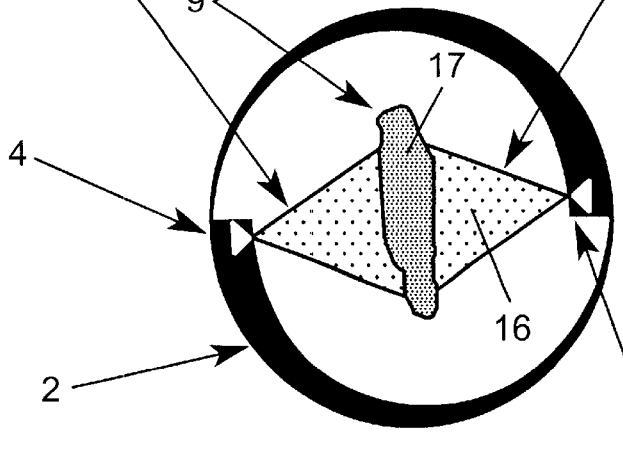
FIG. 1*b* is a cross-sectional representation through the prior art burner outlet of a burner arrangement, with two nozzle outlet openings through which two fuel sprays emerge fanned out for collision.

A cross-sectional representation through the droplet cloud 9 is shown in FIG. 1*b* in the viewing direction of the burner outlet 2. The fuel sprays 5, 6 emerge in fan shape from the nozzle outlet openings 3, 4 and collide in the propagation direction before the droplet cloud 9.

The nozzle outlet openings 3, 4 can be subdivided a plurality of times on the peripheral edge of the burner outlet 2 in order to further increase the droplet density being brought to collision within the volumetric region 7. Such a nozzle arrangement is, in particular, to be provided as a supplement to the central nozzle arrangement (not shown in FIG. 1*a*) within the conical burner.

In the design of the nozzle arrangement in accordance with the invention, two aspects must, in particular, be considered:

1. The fuel sprays 5, 6 which collide must be oriented relative to one another in such a way that as many collision events as possible occur. In particular, attention should be paid to ensuring that the fuel sprays 5, 6 emerging through the nozzle outlet openings 3, 4 are adequately mixed with air so that the fuel disintegrates into individual, singular macroscopic fuel droplets 16. The fuel sprays 5, 6 or individual regions of the fuel sprays 5, 6 formed separately from one another should only collide after the disintegration into individual fuel droplets 16.
2. The atomization rate of each individual nozzle outlet opening 3, 4 should be selected in such a way that the fuel spray 5, 6 forming has a sufficiently large fuel droplet density, so that as many fuel droplets 16 as possible collide with one another and cannot pass through the volumetric region 7, in which the collisions occur, without collision events.

Figure 1C:
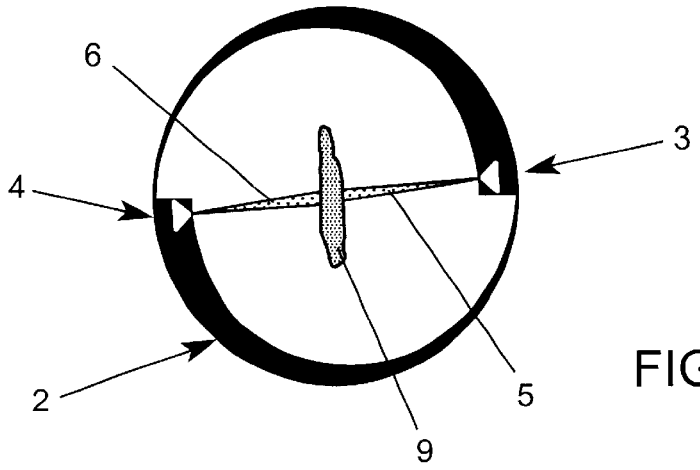
FIG. 1*c* is a cross-sectional representation, as in FIG. 1*b*, but with only slightly divergent fuel sprays.

For the best interaction between two colliding fuel droplets 16, the width of a two-dimensional fuel spray 5, which has formed in fan shape and which collides with a second fuel spray 6, should be approximately of the order of magnitude of the cross-sectional area of all the droplets per unit length, i.e. the colliding fuel sprays 5, 6 should meet one another in bundles, as far as possible, and have a small jet divergence, such as is represented in the embodiment example of FIG. 1*c*. The two fuel sprays 5, 6 emerging from the nozzle outlet openings 3, 4 have only a very slight jet divergence so that they collide tightly bundled in the centre of the burner outlet 2. This ensures that as many collision events as possible take place between the macroscopic fuel droplets 16 of one fuel spray 5 and the macroscopic fuel droplets 16 of the other fuel spray 6.

As an alternative to the arrangement of the nozzle outlet openings 3, 4 represented in FIG. 1*c*, which nozzle outlet openings are provided diametrically opposite to one another on the peripheral circumferential edge of the burner outlet 2, further nozzle outlet openings can also be provided at the burner outlet 2.

The nozzle arrangements represented in FIGS. 1*a* to 1*c* must be arranged relative to one another with great geometric care in three dimensions so that the fuel sprays 5,6 emerging from the nozzle outlet openings 3, 4 can collide while directed towards one another in a suitable manner.

Figure 2:
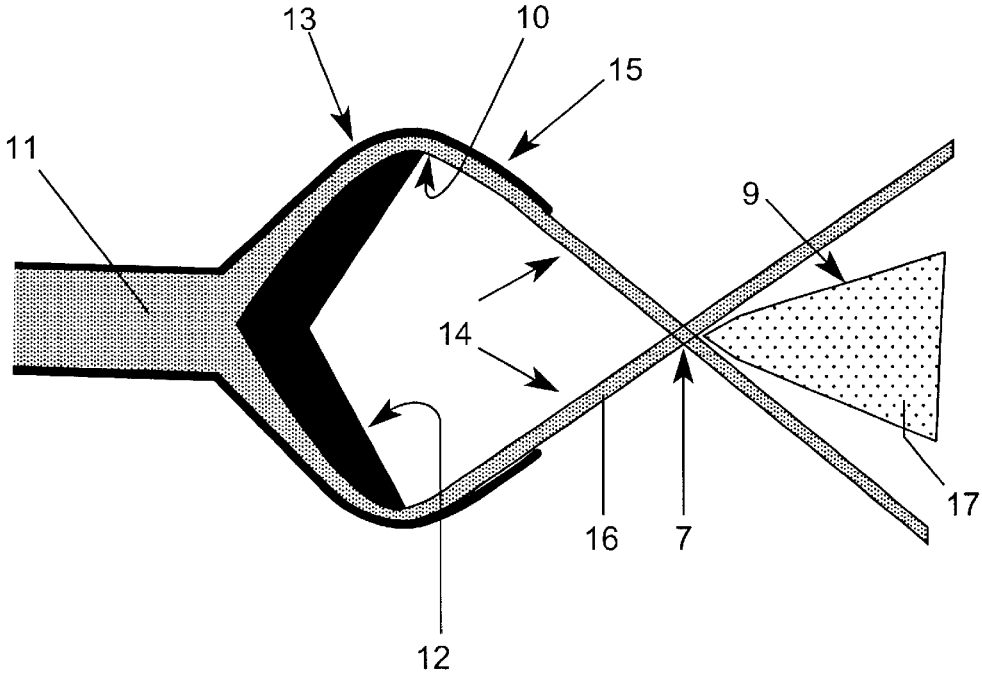
FIG. 2 is a longitudinal sectional representation through an endless slot nozzle opening.

In order to avoid or substantially reduce the complication of such adjustment requirements, a further embodiment example is shown in FIG. 2. This shows, in cross-sectional representation, a nozzle arrangement which has an endless slot nozzle opening 10. Liquid fuel passes via a supply duct 11 into a nozzle head 13 whose flow diameter preferably widens conically. A displacement element 12 centrally introduced within the nozzle head 13 bounds the slot nozzle opening 10, through which the liquid fuel passes as an annular fuel spray 14, in an angular circumferential sense. A deflection element 15 is integrally connected to the nozzle head 13 and this deflection element 15 deflects the fuel spray 14 so that it is directed conically inward. The distance between the nozzle head 13 and the volumetric region 7, in which the individual fuel droplets 16 formed by disintegration processes collide, is dimensioned in such a way that the fuel spray 14 directly emerging from the nozzle head 13 first mixes with the surrounding air and, because of subsequent disintegration processes, individual singular fuel droplets 17 form. The jet path of the fuel spray 14 can, in particular, be individually set by the inclination of the deflection element 15. After the collisions occurring in the volumetric region 7, a droplet cloud 9 forms in which microdroplets with the previously described small droplet diameter collect.

The nozzle arrangement shown in cross section in FIG. 2 can, as a departure from a circular slot nozzle opening, also adopt other slot outlet geometries. As an example, circular-segment-type outlet openings are also conceivable through which at least two separate fuel sprays can meet one another in a colliding manner.

The idea on which the invention is based is the generation of extremely small fuel droplets whose droplet diameters are up to three orders of magnitude smaller than the liquid droplets generated by means of conventional spray technology. This occurs because—as a departure from the conventional process of atomization of liquid by means of air—two liquid droplets are deliberately brought into collision and these droplets in turn burst asunder into a large number of extremely small liquid droplets. Using the atomization principle described above, it is possible to provide burners for gas turbine installations both for the ignition phase and for the base load operation, using a single nozzle arrangement of simple structural design. By means of the measure in accordance with the invention, it is possible to increase the efficiency of gas turbines without, in the process, increasing the design complication and the financial outlay associated with it.

What is claimed is:

1. A method for atomizing fuel for combustion comprising:

(a) introducing combustion air flow tangentially into a hollow conical slot between at least two hollow partial semi-conical bodies;

(b) introducing liquid fuel into a spray nozzle attached centrally to the hollow conical slot;

(c) dividing liquid fuel from a nozzle at an outlet of the semi-conical bodies into a first and a second spacially separated fuel sprays; and (d) directing the separated fuel sprays in a propagation direction relative to one another such that fuel droplets of the first fuel spray collide with fuel droplets of the second fuel spray, the collision of the fuel sprays producing a droplet cloud containing new fuel droplets having a diameter that is smaller than diameters of the droplets of the colliding fuel sprays.

2. The method according to claim 1, wherein the fuel atomization takes place in such a way that the droplet cloud has a main propagation direction which corresponds to an angular bisector of the propagation direction of the colliding fuel sprays.

3. The method according to claim 1, wherein in the case of a pressurization to approximately 500 mbar of the fuel before passage through the nozzle arrangement, a fuel droplet size is generated within the fuel sprays with droplet diameters of up to 3 mm and, after the collision of the fuel droplets, droplet diameters between 10 and 100 $\mu$m are generated.

4. Apparatus for atomizing fuel for combustion comprising:

at least two hollow partial semi-conical bodies, which are fitted into one another in such a way that there longitudinal axes of symmetry extend radially offset relative to one another and which encloses at least two tangential air inlet slots for a combustion air supply flow and a hollow interior conical space and forming a burner outlet, a nozzle for liquid fuel mounted on the bodies, the nozzle having at least two spacially separated nozzle outlet openings, the nozzle outlet openings being arranged to cause fuel passing through the nozzle to be formed into fuel sprays and to cause the fuel sprays to collide with one another, the nozzle openings being arranged opposite to one another in the partial conical bodies.

5. The apparatus according to claim 4, wherein the nozzle outlet openings respectively impose propagation directions on fuel sprays being formed, which propagation directions enclose an angle $\alpha$, where $0° < \alpha \leqq 180°$.

6. The apparatus according to claim 4, wherein the nozzle outlet openings are arranged at the burner outlet in the partial conical bodies.

7. Apparatus for atomizing liquid fuel for combustion comprising nozzles for atomizing liquid fuel to form a fuel spray, the nozzles including a slot nozzle opening and a deflection element positioned to deflect a fuel spray emerging from the slot opening in such a way that the fuel spray converges in a narrowly limited volumetric region.

8. The apparatus according to claim 7, wherein the slot nozzle opening is of circular configuration so that the fuel spray is formed in the manner of a hollow cone which converges to a point.

9. The apparatus according to claim 7, wherein the deflection element surrounds the slot nozzle opening in one piece and is configured in the manner of a hollow truncated cone whose maximum diameter directly adjoins the slot nozzle opening.

* * * * *